United States Patent [19]

Brotz

[11] Patent Number: 5,005,110

[45] **Date of Patent: * Apr. 2, 1991**

[54] ELECTROSTATIC DISPLAY DEVICE

[76] Inventor: Gregory R. Brotz, P.O. Box 1322, Sheboygan, Wis. 53081

[ * ] Notice: The portion of the term of this patent subsequent to Jul. 17, 2007 has been disclaimed.

[21] Appl. No.: 553,866

[22] Filed: Jul. 16, 1990

Related U.S. Application Data

[63] Continuation-in-part of Ser. No. 475,910, Feb. 6, 1990, Pat. No. 4,842,504.

[51] Int. Cl.[5] ..... F21S 3/00

[52] U.S. Cl. ..... 362/84; 362/260; 362/806

[58] Field of Search ..... 362/84, 260, 806, 811, 362/101

[56] References Cited

U.S. PATENT DOCUMENTS

| | | | |
|---|---|---|---|
| 3,531,635 | 9/1970 | Hancock | 362/101 |
| 4,072,855 | 2/1978 | Marchese | 362/101 |
| 4,170,035 | 10/1979 | Walker | 362/806 |
| 4,942,504 | 7/1990 | Brotz | 362/806 |

*Primary Examiner*—Ira S. Lazarus
*Assistant Examiner*—Richard R. Cole
*Attorney, Agent, or Firm*—William Nitkin

[57] ABSTRACT

An electrostatic display device having a plurality of particles moving back and forth in a chamber illuminated by light. The chamber has oppositely charged top and bottom plates whereby the particles are alternately electrostatically attracted to and repelled from the plates while illuminated by the light, thus creating a constantly moving decorative light display.

5 Claims, 3 Drawing Sheets

ELECTROSTATIC DISPLAY DEVICE

This application is a continuation in part of my previous application under the same title, filed Feb. 6, 1990, Ser. No. 475,910, now U.S. Pat. No. 4,842,504.

BACKGROUND OF THE INVENTION

1. Field of the Invention

The device of this invention resides in the area of decorative light displays and more particularly relates to an electrostatic device having dynamic movement of illuminated particles for amusement of the viewer.

2. Description of the Prior Art

Light displays are well known in the prior art such as blinking lights and more recently, laser light displays. Also known in the prior art is the utilization of blacklights which emit ultraviolet rays to illuminate brightly colored fluorescent objects.

SUMMARY OF THE INVENTION

It is an object of this invention to provide an electrostatic device which utilizes a light in association with a viewing chamber to illuminate a multiplicity of moving particles within the chamber to produce a visual display.

One embodiment of the device of this invention provides a chamber having at least one transparent side with a plurality of electrostatic plates disposed therein surrounding a blacklight fluorescent bulb. A plurality of apertures are disposed within the plates. A large plurality of fluorescent particles are moved electrostatically within the chamber, such particles being illuminated by the blacklight to create an exciting and dynamic visual display. In another embodiment, the viewing chamber extends from a chamber containing the electrostatically charged plates and a black light source shines light into such viewing chamber against the moving fluorescent particles. In yet another embodiment the chamber has one of its electrostatic plates provided with light-admitting apertures in the nature of a screen. This embodiment utilizes a system of scattering a laser light beam against the moving particles to obtain a decorative and entertaining effect.

DESCRIPTION OF THE PREFERRED EMBODIMENT(S)

Figure 1:
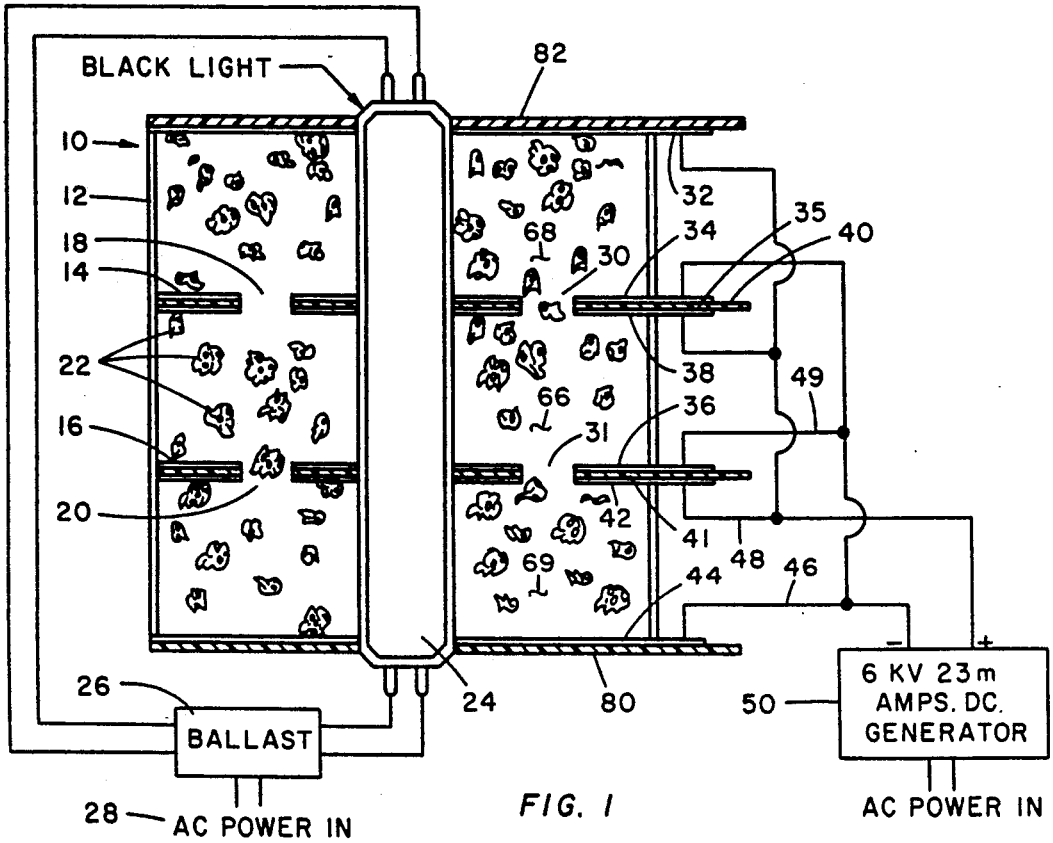
FIG. 1 illustrates a cross-sectional view through one embodiment of the electrostatic display device of this invention.
Figure 3:
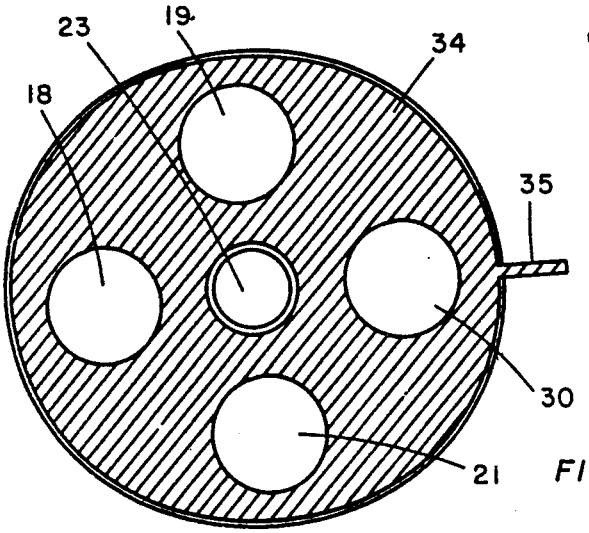
FIG. 3 illustrates a top view of an electrostatic plate.

FIG. 1 illustrates a cross-sectional view through an embodiment of the electrostatic display device of this invention. Seen in this view is chamber 10 which has transparent side 12 and has disposed extending vertically in the center thereof fluorescent blacklight 24 which is powered through ballast 26 from AC power source 28. Seen in this embodiment utilizing two electrostatic plates are first electrostatic plate 14 and second electrostatic plate 16 each having a plurality of apertures defined therein, the central aperture 23 of each electrostatic plate for receipt therethrough of blacklight 24. Other apertures are arrayed through the electrostatic plates which electrostatic plates in the embodiment illustrated are generally disposed perpendicular to vertically disposed blacklight 24. The cross-sectional view of FIG. 1 cuts through two of the apertures in first electrostatic plate 14 being apertures 18 and 30. Also seen in FIG. 1 are apertures 20 and 31 in second electrostatic plate 16. FIG. 3, showing a top view of first electrostatic plate 14, illustrates other apertures formed therein such as apertures 19 and 21 which are not seen in the cross-sectional view of FIG. 1. Each electrostatic plate has disposed above and below its central electrically insulative core an electrically conductive surface such as first electrostatic plate 14 showing top electrically conductive surface 34 and bottom electrically conductive surface 38 disposed on either side of central core 40. These electrically conductive surfaces extend over each side of the planar surfaces of the electrostatic plates and then also extend out of chamber 10 through transparent side 12 where electric wires can be attached thereto.

Figure 2:
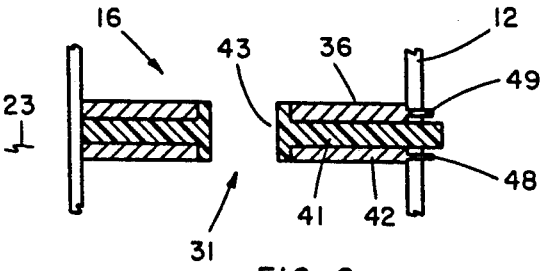
FIG. 2 illustrates a partial cross-sectional view of an electrostatic plate showing its electrical connections.
Figure 4:
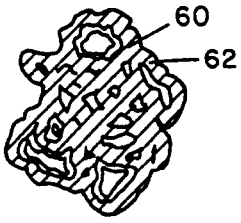
FIG. 4 illustrates an enlarged view of a particle coated with fluorescent paint.

FIG. 2 illustrates a partial cross-sectional view of second electrostatic plate 16 extending from blacklight 24. Seen in this view is top electrically conductive surface 36 and bottom electrically conductive surface 42 surrounding central plate core 41 which core 41 can be non-conductive and helps support second electrostatic plate 16 in position. Around each aperture, such as aperture 31 in FIG. 2, core 41 extends upwards and downwards to form an insulative wall 43 around the inside of each aperture to help allow the particles to easily pass therethrough. Extending out beyond side 12 of chamber 10 are electrical leads 48 and 49 which connect to a 6000 volt 23 milliamps DC generator 50 which static charge generator is also interconnected to all of the other electrically conductive surfaces with the upper electrically conductive surface of each section of the chamber such as sections 64, 66, and 68 having a positive-charged electrically conductive surface and such sections also having a negatively charged electrically conductive surace at the bottom thereof. Bottom 80 and top 82 of chamber 10 also have charged electrically conductive surfaces conforming to having a positive charge at top 82 and a negative charge at bottom 80. Between such sections such as sections 64, 66 and 68 are apertures formed in the electrostatic plates such as apertures 31 and 30. Within chamber 10 is placed a multiplicity of small particles capable of holding an electrostatic charge such as aluminum particles or equivalent which have been coated with fluorescent paint. A coated particle is seen enlarged in FIG. 4 showing aluminum particle 60 coated with fluorescent paint 62. These small particles are extremely lightweight and even when coated with fluorescent paint are easily moved toward the electrically charged surfaces to which they are attracted.

Figure 5:
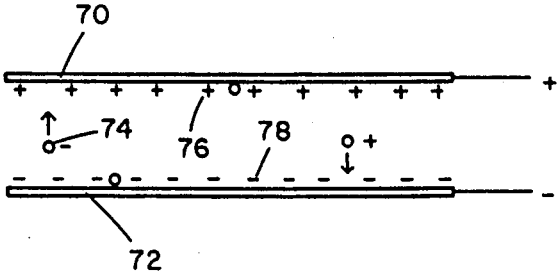
FIG. 5 illustrates the attraction/repulsion of electrostatically charged particles between electrostatic plates.

The device in operation, as seen in FIG. 5, carries negative charge 78 on the lower plate of each chamber section such as lower plate 72 and positive charge 76 on upper plate 70. When the device is not operating, particles 74 rest on the bottom and when the device is turned on, the particles take on the negative charge of lower plate 72. Since the particles and lower plate 72 are then of the same charge, particles 74 are repelled and at the same time attracted by the positive charge 76 of upper plate 70 so that the particles move upwards. Then the negative charge on particles 74 dissipates and particles 74 acquire the positive charge 76 of upper plate 70 upon contact therewith. This positive charge on particles 74 then causes particles 74 to be repelled from top plate 70 back downward to negatively charged lower plate 72. This process continues with the particles being attracted and then repelled and so on causing the particles to be constantly in motion between the top and bottom plates of the chamber's sections. Some of the particles pass through the series of apertures in the electrostatic plates such as apertures 18 and 30 and move from one chamber section to another such as from chamber section 64 to chamber section 66 and then to chamber section 68. The particles move up and down within each section and within the entire chamber and through the apertures, bouncing back and forth between the electrostatic plates and passing at times through the apertures. When the particles are illuminated by black-light 24, a display of moving fluorescing particles is created. The particles can be coated with different fluorescent colors, for example some particles can be red, blue or yellow as desired.

Figure 6:
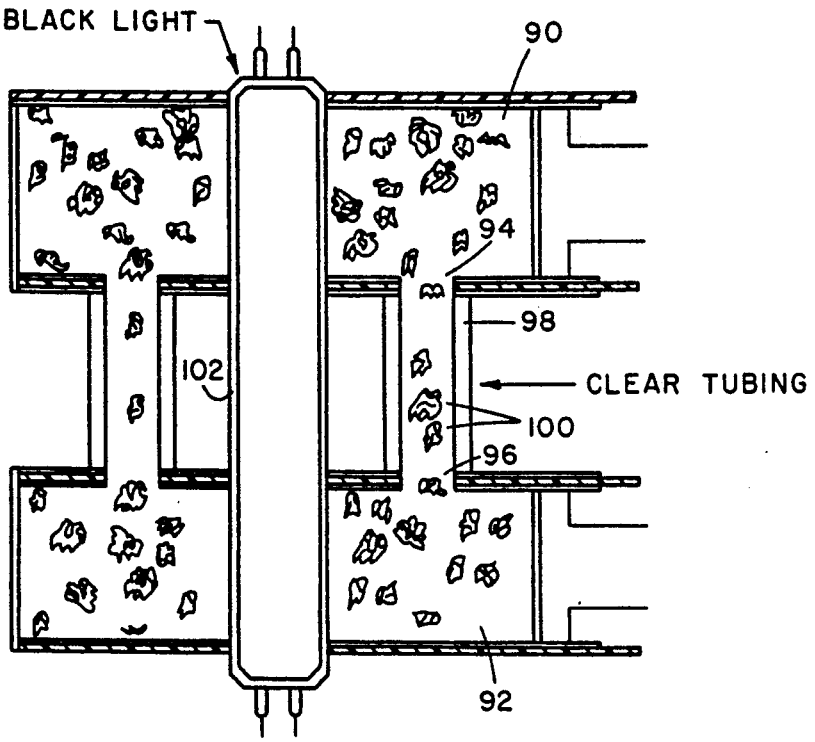
FIG. 6 illustrates a cross-sectional view through an alternate electrostatic display device.
Figure 7:
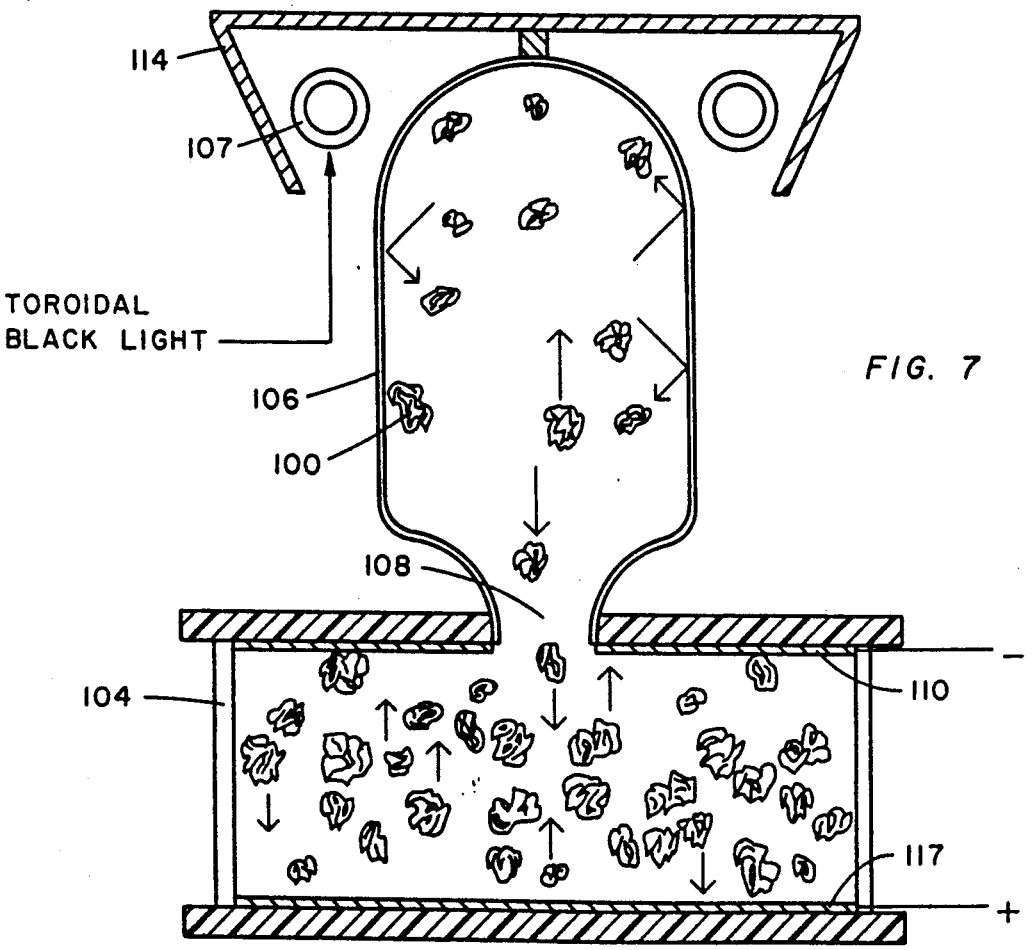
FIG. 7 illustates a cross-sectional view through an alternate electrostatic display device with separate plate chamber and viewing chamber.

FIG. 6 illustrates an alternate embodiment where upper chamber 90 and lower chamber 92 are separated at their corresponding plate apertures such as apertures 94 and 96 by elongated clear tubes 98 through which particles 100 pass and are illuminated by black light 102. A further alternate embodiment is shown in FIG. 7 illustrating that the chamber with charged plates 104 can be separated from viewing chamber 106 and that black light 107 can be external of both charged plate chamber 104 and viewing chamber 106. In the embodiment of FIG. 7 an aperture 108 is provided in one of the charged plates through which aperture particles 100 can bounce as they are repelled back and forth between plates 110 and 112. Some particles will, by chance, pass through aperture 108 and bounce around in transparent viewing chamber 106. Circular fluorescent black light 107 can be disposed above viewing chamber 106 to illuminate the particles bouncing around therein. When the particles lose their momentum, they fall back through aperture 108 to start being repelled between plates 110 and 112 until the particles again pass through aperture 108 back into viewing chamber 106. A shield 114 can be placed around black light 107 to shield the viewer's eyes and to reflect more of the black light into viewing chamber 106.

Figure 8:
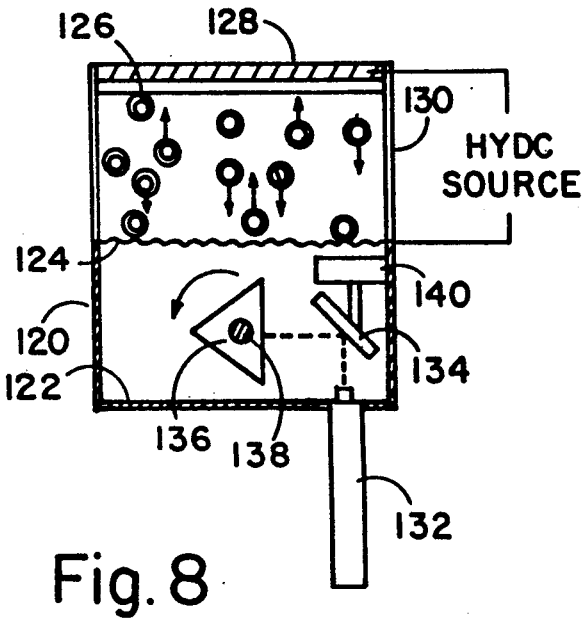
FIG. 8 illustrates a cross-sectional view of an alternate chamber utilizing laser illumination of particles.

FIG. 8 illustrates an alternate embodiment having chamber 120 with an upper portion of the chamber separated by lower electrode plate 124 which is comprised of a screen mesh-like material that can carry a charge and which will allow light to pass therethrough, such as a metal window screening material, but which will not allow particles through the openings in the mesh. Within the upper portion of chamber 120 are particles 126 such as described above or which may have no fluorescent coating which particles move back and forth between upper electrode plate 128 and screened lower electrode plate 124 in the fashion as described above. A power source running to upper electrode plate 128 and screened lower electrode plate 124 as in the above-mentioned embodiments. This embodiment, thou@h, uses a different source of illumination within the bottom of chamber 120 which bottom can incorporate a reflective inner surface 122 and has disposed laser 132 which can be a white light or other type of laser which directs its beam to vibrating mirror 134 which is moved by mechanism 140 as will be described further below and which mirror directs the laser beam, as shown by dotted lines, to rotating prism 136 which rotates on prism shaft 138. The prism rotates continuously directing the laser beam, which is directed all along the axis of prism 136 by mirror 134, throughout chamber 120 in a broken scattered path but at a speed so as to appear to intermittently bathe the particles in light because of the prism's fast rotation which breaks up and bends the laser light beam and directs it onto the randomly moving particles. At some points in time the prism directs the laser beam to reflective inner surface 122 where the beam will also be reflected back upwards through screen plate 124 into the viewing area.

Figure 9:
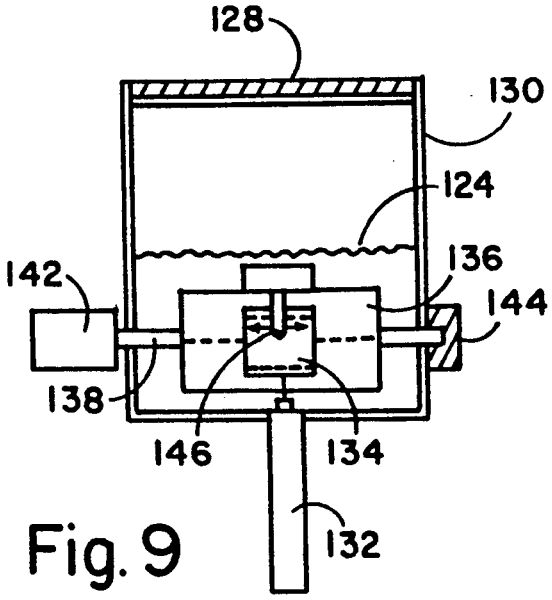
FIG. 9 illustrates a cross-sectional view at 90 degrees through a portion of the chamber of FIG. 8.
Figure 10:
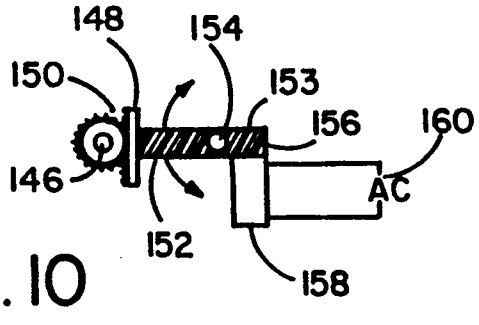
FIG. 10 illustrates the mirror vibrating mechanism utilized in the embodiment of the device as shown in FIGS. 8 and 9.

FIG. 9 illustrates a cross-sectional view through a portion of FIG. 8 showing prism 136 on prism shaft 138 which is held on one end by block 144 and driven by motor 142 to rotate it. Mirror 134 is seen mounted on mirror shaft 146 and is moved back and forth directing the laser light beam along the longitudinal length of the prism 136. One mechanism that can be utilized to move the mirror back and forth quickly across the prism is illustrated in FIG. 10 which is a top view through mechanism container 140. While other means could be used to rotate the mirror, this particular means is advantageous because of its fast vibration to quickly cause the mirror to scan the prism while the prism is speedily rotating causing the light to give the appearance of being in many places at once within illuminating chamber 120 which can be viewed through the transparent viewing area 130. Within mechanism container 140 the mirror shaft extends upward to a rack and pinion gear. Rack 148 moves back and forth moving pinion gear 150 causing mirror shaft 146 to partially rotate back and forth quickly which action vibrates the attached mirror. One way of causing rack 148 to move back and forth quickly is to mount it on rubber arm 156 which is pivoted on shaft 154 with the distance 152 between shaft 154 and rack 148 being longer than the distance 153 between the shaft 154 and the end of arm 156 to which end of rubber arm 156 is attached a piezoelectric crystal 158 powered by AC current 160. This arrangement causes the small vibrating movement from piezoelectric crystal 158 to push and pull rubber arm 156 at its attachment thereto back and forth which movement is magnified at rack 148 due to the longer distance 152 of the rubber arm 156 beyond shaft 154 which quickly moves rack 148 back and forth against pinion 150, causing very fast continuous vibration of the mirror to achieve the desired result in the display chamber of this invention. The rotating prism breaks up the white light from the laser into a full spectrum of colors which change depending on the speed of the prism's rotation and the vibrating mirror's movement along with the angle at which the light beam strikes the prism and the color components of the laser beam of light. It should be noted that although the prism shown has its sides positioned at 45 degrees to one another, other angles of positioning of the prism's sides can he utilized. A pulsed laser beam can also be used which can be sequenced by a controller which also controls the prism rotation and mirror movement to achieve a variety of different light and color effects.

Although the present invention has been described with reference to particular embodiments, it will be apparent to those skilled in the art that variations and modifications can be substituted therefor without departing from the principles and spirit of the invention.

I claim:

1. An electrostatic display device comprising:

a viewing chamber having at least one transparent side;

an upper electrostatic plate having an electric charge;

a lower electrostatic plate having an opposing charge from the charge of said upper electrostatic plate;

means for producing light to illuminate said viewing chamber;

a plurality of electrostatically charged particles; and means for generating an electric current to said upper and lower electrostatic plates causing said particles to be attracted to the electrostatic plate of opposite charge of said particles, said particles acquiring the charge of such electrostatic plate to be then repelled and attracted to said electrostatic plate of opposing charge where said particles then change their charge to the same charge of that electrostatic plate where said particles are again repelled and attracted to the electrostatic plate of opposing charge, such process of changing charges continuing, causing the particles to move within said viewing chamber as said particles are illuminated by said light.

2. A method of creating an electrostatic light display, comprising the steps of:

providing a plate chamber having oppositely charged electrostatic plates at its top and bottom;

providing a source of light;

providing a plurality of particles capable of holding an electric charge and being illuminated by said light;

attracting said charged particles to the electrostatic plate of opposite charge;

changing the charge of said particles to be the same as the electrostatic plate to which they have been attracted;

repelling said like-charged particles from said then like-charged electrostatic plate to said oppositely charged electrostatic plate; and repeating said attraction and repulsion process causing said particles to move back and forth within said chamber; and illuminating said moving particles by said light.

3. An electrostatic display device comprising:

a viewing chamber having at least one transparent side;

an upper electrostatic plate having an electric charge;

a lower electrostatic plate having a plurality of apertures defined therein for the passage of light therethrough, said lower electrostatic plate having an opposing charge from the charge of said upper electrostatic plate;

a plurality of electrostatically charged particles disposed within said viewing chamber, said particles being larger than the apertures defined in said lower electrostatic plate; and means for generating an electric current to said upper and lower electrostatic plates causing said particles t be attracted to the electrostatic plate of the opposite charge of said particles, said particles acquiring the charge of such electrostatic plate to be then repelled and attracted to said electrostatic plate of opposing charge where said particles then change their charge to the same charge as that of the electrostatic plate where said particles are again repelled and attracted to the electrostatic plate of opposing charge, such process of changing charges continuing, causing the particles to move within said viewing chamber; and means for producing light to illuminate said particles as they move beneath said lower electrostatic plate, said means including:

a laser light;

a vibrating mirror against which said laser light is directed; and a rotating prism receiving the light reflected by said vibrating mirror at various points and directing said light into said viewing chamber while rotating.

4. The device of claim 1 wherein said prism is elongated and disposed and rotated horizontally on an axis and said vibrating mirror directs said laser light on the horizontal axis of said prism.

5. The device of claim 4 further including:

a shaft having a first and second end on the first end of which said vibrating mirror is mounted;

means to rotate said shaft back and forth including:

a pinion gear mounted at the second end of said shaft;

a rack engaging said pinion gear;

an arm having a first and second end on which said rack is mounted on said arm's first end;

a pivot member positioned on said arm near said arm's second end; and a piezoelectric crystal attached to the second end of said arm, said crystal adapted to vibrate.

* * * * *